United States Patent [19]

Pratt, Jr.

[11] 3,974,412

[45] Aug. 10, 1976

[54] SPARK PLUG EMPLOYING BOTH CORONA DISCHARGE AND ARC DISCHARGE AND A SYSTEM EMPLOYING THE SAME

[75] Inventor: George W. Pratt, Jr., Wayland, Mass.

[73] Assignee: Massachusetts Institute of Technology, Cambridge, Mass.

[22] Filed: Feb. 3, 1975

[21] Appl. No.: 546,232

[52] U.S. Cl. ..... 313/131 R; 123/169 EL; 123/169 MG; 313/138; 313/139; 313/141

[51] Int. Cl.[2] ..... H01T 13/20

[58] Field of Search ..... 313/118, 131 R, 131 A, 313/134, 141, 145, 133, 138, 139, 140, 142; 123/169 R, 169 EL, 169 MG

[56] References Cited

UNITED STATES PATENTS

| | | | |
|---|---|---|---|
| 1,247,975 | 11/1917 | Linn | 313/143 X |
| 1,905,957 | 4/1933 | Anderson | 313/131 R |
| 2,129,576 | 9/1938 | Gorny et al. | 313/131 R X |
| 2,798,980 | 7/1957 | Beardslee | 313/145 X |
| 2,926,275 | 2/1960 | Péras | 313/131 R |
| 3,049,644 | 8/1962 | Bowlus et al. | 313/131 R X |
| 3,538,372 | 11/1970 | Terao | 313/142 X |

*Primary Examiner*—Siegfried H. Grimm
*Attorney, Agent, or Firm*—Arthur A. Smith, Jr.; Robert Shaw; Martin M. Santa

[57] ABSTRACT

A spark plug wherein corona discharge is employed to create a long arc and to determine, in part, the path of the arc, electrodes of the spark plug being shaped, oriented and positioned to create an arc of desired length and at a desired location as well as to effect electromagnetic interaction between electric current in the arc and the electrodes to provide a force on the arc which acts to control its spatial behavior. The spark plug includes means to enhance the electromagnetic interaction.

31 Claims, 9 Drawing Figures

SPARK PLUG EMPLOYING BOTH CORONA DISCHARGE AND ARC DISCHARGE AND A SYSTEM EMPLOYING THE SAME

The present invention relates to spark plugs employing both corona discharge and arc discharge and to systems employing the same.

Attention is called to an application for Letters Patent Ser. No. 508,381, filed Sept. 23, 1974, (Pratt, Jr.) and to the prior art presented in connection with the application by the applicant. There accompanies herewith a Master's thesis entitled "Pulse-aided Arcs Under Pressure, Spacing and Voltage" (Miller); the work upon which the thesis is based was done under the supervision of the present inventor.

The discharge device described in said application uses corona discharge and arc discharge in various ways. The present invention arose from further work on the same general subject matter, an object of the present invention being to control the arc of a spark plug in a way that allows some control over the path followed by the arc.

A further object is to provide a substantially long arc and one that, once initiated, can be moved about to alter the length of the same to enhance combustion in a system by virtue of such controlled length as well as by virtue of the movement alone.

A still further object is to provide a spark plug wherein movement of the arc is effected by electromagnetic interaction between electric current in the arc and electric current in the electrodes of the spark plug.

Another object is to provide a spark plug wherein magnetic particulate is employed to enhance such electromagnetic interaction.

Still another object is to provide a spark plug wherein the electrodes and/or insulating parts employ low work function materials to promote corona and arc discharge.

Still another object is to provide a spark plug that acts to generate active chemical species in the corona discharge to facilitate and enhance combustion.

These and still further objects are elaborated upon in the description that follows.

The invention is henceforth described with reference to the accompanying drawing in which.

Before going into a detailed explanation of the structure of the spark plug, there follows first a brief, overall discussion. The purpose of the ignition device herein disclosed is to create an arc discharge whose length is much longer than ordinarily obtainable and whose length and disposition can be electronically controlled. A corona discharge is a precursor to the arc and the corona may be used for several purposes. First it may be used to charge fuel droplets that may be present, for example, in fuel injection engines, and to concentrate the charged fuel droplets so as to affect the air-to-fuel ratio to enhance the ignition and combustion process. Second, the corona will act to generate active radicals which promote the combustion process. Third, the corona can establish a path along which an arc discharge is guided or preferably established. This favorable path can be substantially longer than ordinarily obtainable. For example, it was discovered that an arc 0.340 inches long was established repeatedly at 33,000 volts and at 140 psi using a structure like that shown in FIG. 6. The length of path of the arc was discovered to be only weakly dependent on pressure after a certain threshold voltage is attained. Furthermore, by proper design of the electrode configuration and the electrodes, it is possible to control the path and consequently the length of the arc discharge. This control is acquired in part and in appropriate circumstances by virtue of the repulsion of two oppositely directed electric currents. The duration of the corona phase of the plug firing can be controlled and may vary in time down to the microsecond regime.

Figure 1:
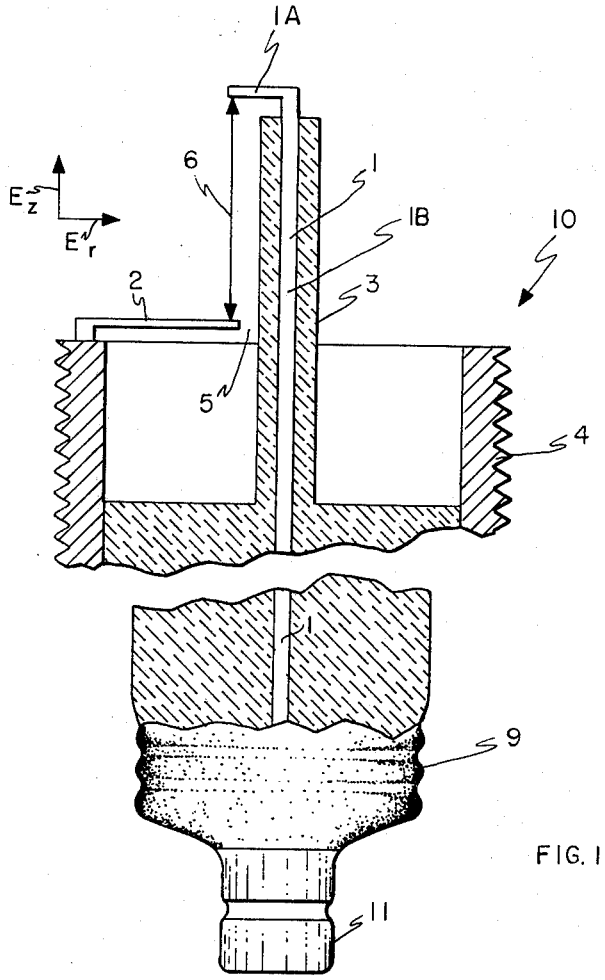
FIG. 1 is a partial elevation view, partly cutaway, showing a spark plug that embodies the present concepts.
Figure 2:
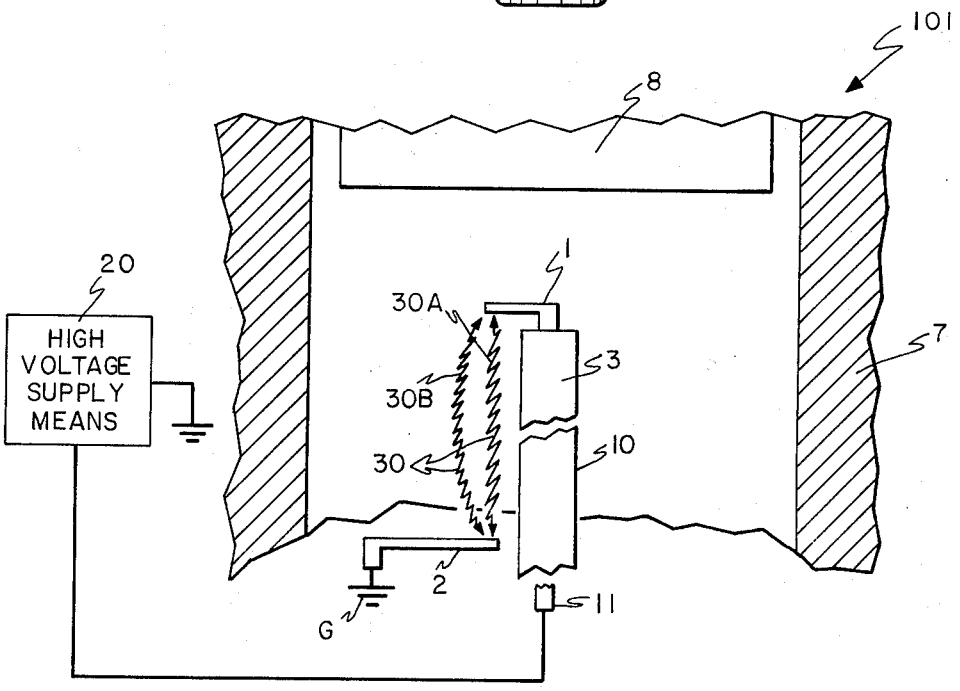
FIG. 2 is a highly diagrammatic representation showing a part of the combustion system of an automobile and including a schematic representation of the spark plug of FIG. 1.

With reference now to FIG. 2, a combustion system is shown at 101 comprising a spark plug 10 and high voltage supply means 20 interconnected. As shown in FIG. 1, the spark plug 10 has a base or body 4 which, as in a conventional plug, is the threaded metal structure that threads into the engine block of any automobile. A high voltage axial or central electrode 1 extends from an input terminal 11 at a first end of the plug 10 through the plug body 4 and outward to a second end of the plug axially separated from the first end. The central electrode is surrounded by an insulator 9 which isolates the electrode 1 from the plug body 4. The part of the electrode 1 that extends outward from the base 4 is surrounded by an insulating jacket 3 that is merely an extension of the insulator 9. A ground electrode 2, attached to the body 4, extends inward from the body 4 to the vicinity of the electrode 1. The electrodes 1 and 2 act in combination with the high voltage means to create, first, a corona discharge and, then, an arc discharge through the corona, as now discussed.

The electrode 1 is a high voltage elongate axial electrode which, as above noted, extends and outward from the base or body 4 of the spark plug. The outwardly extending part of the electrode 1 is covered by the thin (i.e., ~1mm) insulating jacket 3 except for a small exposed portion 1A at its free end. (Strictly speaking, the exposed portion 1A should be called the "electrode", but through this specification the high voltage electrode includes the electrical conductor between the input terminal 11 at the first end of the plug, to and including the exposed portion 1A at the second end thereof). The electrode 2 (which is a ground electrode in the embodiment shown) is disposed adjacent the high voltage electrode 1 at a region 5 displaced from the exposed portion 1A by a substantial gap 6, and is separated therefrom at the region 5 by the insulating jacket 3 so that the distance from the ground electrode to the axial electrode through the jacket at the region 5 is much less than the distance from the ground electrode across the gap 6 to the exposed portion 1A. Hence, in an operating system, corona discharge (which can in some cases be called pre-strike ionization) can be created between the high voltage electrode and the ground electrode; the corona begins in the high electric field region 5 wherein the two electrodes are closest together and spreads generally along the insulating jacket toward the exposed portion 1A due to an axial component of the electric field. When the corona discharge reaches the vicinity of the exposed portion 1A, an arc discharge 30 occurs through the corona between the exposed portion of the first electrode 1 and the second or ground electrode 2 in the air space surrounding the insulating jacket with a component of the arc being substantially parallel to the surface of said jacket: the arc 30 is a long arc compared to the ~0.030 to 0.040 inch arc in more conventional spark plugs, being the order of 0.340 inches (i.e., 8.6mm) or more in length. The arc 30 follows a path whose shape and location are determined, in part, by the corona discharge and, therefore, by the shape and position of the electrodes 1 and 2. The arc 30 will tend to occur in close proximity to the electrode 1, thereby causing it initially to contact the surface of the insulator 3. In the plug 10, the electrodes 1 and 2 are shaped and positioned to provide a configuration wherein the initial surface discharge nature of the arc is affected by the electromagnetic interaction between the electric current in the arc and the electric current carried in the electrodes so that the arc will tend to lift from the insulator surface by virture of said electromagnetic interaction from the position marked 30A to the position marked 30B. More specifically, an electric current, say, upward in the electrode 1 at the stem portion shown at 1B will interact electromagnetically with a current downward in the arc 30, causing the arc 30 to move radially outward away from the stem portion 1B of the electrode 1. The outward movement of the arc 30 has at least three felicitous consequences: it removes the arc from contact with the surface of the insulator 3, thereby reducing fouling problems; it can be exploited to lengthen the arc, thereby increasing the ignition volume in the system 101; and it can create a continuously changing position of the arc which increases the ignition volume an even greater amount. The corona and the arc are discussed further in later paragraphs.

The insulating jacket 3 can be made of conventional ceramic insulating material used in spark plugs. The foregoing electromagnetic interaction can be enhanced, however, by distributing through the insulating material prior to formation a small amount of $Fe_3O_4$ or some other magnetic particulate. The particulate will increase the magnetic field due to current in the electrode 1 without degrading the insulating properties of the jacket 3. Small magnetic particles in the 100 to 1000A range of sizes could act effectively in this regard.

As above noted, corona begins in the region 5 and moves along the insulating jacket; as it does, it is subjected to lines of force between the ground electrode and the exposed portion 1A of the high voltage electrode in an operating system 101 to provide an arc. The arc thus formed moves along a path generally parallel to the stem portion 1B of the axial electrode 1 which is covered by the insulating jacket. The part of the arc is, then, determined in part by the corona, and the shape of the corona is determined to a large extent by the geometry of the electrode 1. Hence, the jacketed high voltage electrode serves to guide the corona discharge.

Figure 3:
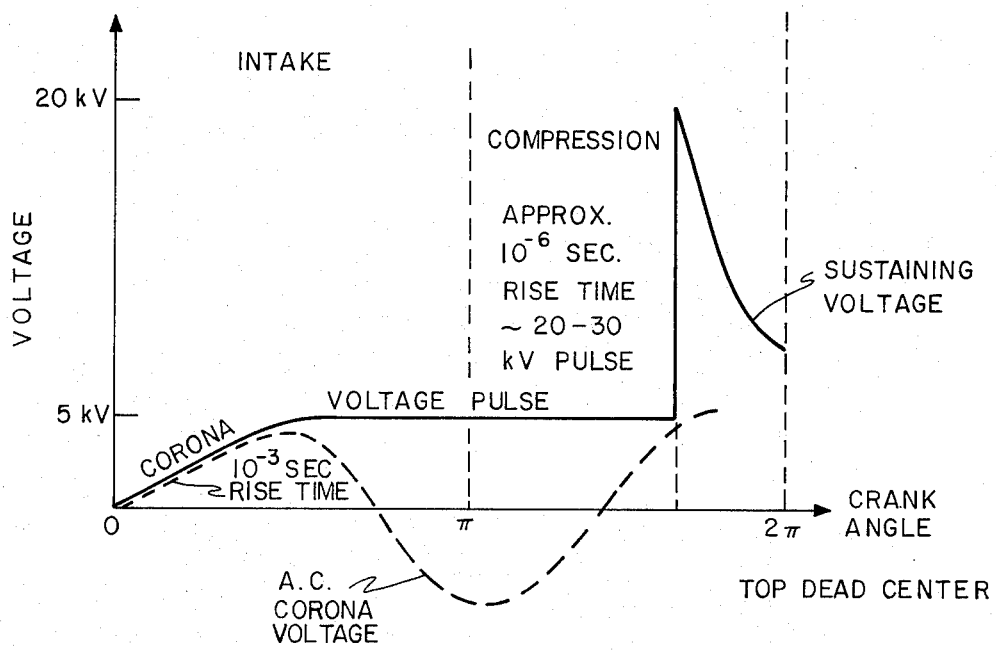
FIG. 3 shows a voltage curve of an electric potential that may be applied to the spark plug of FIG. 1.

The spark plug 10 has a conventional base 4 that threads into an engine block at electrical ground, as above noted. In FIG. 2 the elements labeled 7 and 8 represent a cylinder and piston, respectively, of such engine. The spark plug disclosed herein can also be used in rotary engines and, in general, in combustion systems that require spark ignition devices. The high voltage supply means can be a capacitance discharge system or a conventional automobile coil, or such means can be a supply that furnishes a waveform to provide timing in connection with both the corona discharge and the arc discharge. (In FIG. 3 there is shown a time-voltage waveform that is slow rising to about 5 kv to provide corona discharge and is then fast rising to about 20 kv to provide arcing with a sustaining voltage thereafter). Further, in the immediate vicinity of the spark plug 10 there will be an air-fuel mixture as discussed in said application Ser. No. 508,381; and, in this connection, the duration of the corona discharge can affect the composition of said mixture. Also, since the amount of electrical energy which can be dissipated in the arc is a function of the arc length, the present system introduces great benefits to any combustion system, particularly in lean burning engines having a high air-to-fuel ratio. And, it can now be seen, such energy can be increased as the arc is moved outward since, as distinguished from prior-art system, in the present system the arc length is or can be increased. In what follows, the theories underlying the present invention are given more rigorous treatment than is done in the foregoing explanation; and there are described modifications of the spark plug of FIG. 1.

Work done to date indicates that a corona is first established between the ground electrode 2 and the high voltage electrode 1 through the insulator 3. The charged species in the corona experience an electric field having a radial component $E_r$ in FIG. 1 directed perpendicular to the axially directed high voltage electrode 1, and an axial component $E_z$ directed parallel to electrode 1. The radial and axial currents $J_r$ and $J_z$, respectively, are $$J_r = \sigma_r E_r$$

$$J_z = \sigma_z E_z$$

where $\sigma_r$ is the radial conductivity through the insulating jacket 3 to the electrode 1 and $\sigma_z$ is the conductivity along the surface of the jacket 3.

Although $E_r >> E_z$, because of the insulating jacket, $\sigma_z >> \sigma_r$. An arc can be established in the axial direction yielding $J_z >> J_r$. The current in the arc is essentially equal in magnitude and opposite in direction to the current flowing in the insulated high voltage electrode at 1B. These two currents exert a force on each other in the radial direction forcing them apart. Since the arc can move in space, it will lift off the surface of the insulating jacket 3, as previously mentioned. The radially directed force F per unit length l acting on the arc is $$\frac{F}{l} = \frac{2 \times 10^{-7}}{a}(I_{arc})^2$$

where $F$ is in newtons, l and $a$ are in meters, and $I_{arc}$ in amperes. The current $I_{arc}$ is not constant when the arc discharge occurs. Immediately after the arc is established, $I_{arc}$ can be quite large while the self-capacitance of the plug is discharged. Values as high as 200 amperes can be attained over a time scale of $10^{-9}$ seconds. This high current quickly drops to a value of approximately 50 mA during the dissipation of the magnetic energy in the coil of a conventional ignition system. The self-capacitance of the plug can be deliberately controlled to affect the value of $I_{arc}$. The duration of the self-capacitance discharge can be adjusted by manipulation of the RC time constant of said discharge. If, for example $I_{arc}$ is taken to be 10 amperes and the arc 30 has pushed away from the axial electrode 1 to a distance $a$ of 0.5 cm, then $$\frac{F}{l} = \frac{2 \times 10^{-7} \times 10^{2}}{5 \times 10^{-3}} = 0.4 \times 10^{-2} \ \frac{\text{newtons}}{\text{meter}}$$

The force acting on an individual electron or positive ion in the arc would be the order of $$0.4 \times 10^{-2} \times 10^{-10} = 0.4 \times 10^{-12} \text{ newtons}$$

This is to be compared with the force $F_1$ on the electron or positive ion due to the electric field that drives the arc. If the field in the gap 6 in FIG. 1 is 30,000 V/cm, the corresponding driving force $F_1$ is $$F_1 = 1.6 \times 10^{-19} \times 3 \times 10^{6} = 4.8 \times 10^{-13} \text{ newtons}$$

Hence, the force $F$ acting to push the arc away from the surface of the insulator 3 is comparable to the electric force $f_1$ that produces the arc itself. This tendency to lift the arc off the surface is important because it can be used to establish the arc away from a surface that could otherwise quench the combustion process, it allows better propagation of the combustion process in all directions away from the arc, and it reduces plug fouling since a surface current is strongly pushed off the surface. The tendency to push the arc away from the surface is of further importance as it can be used to control the length of the arc.

Figure 6:
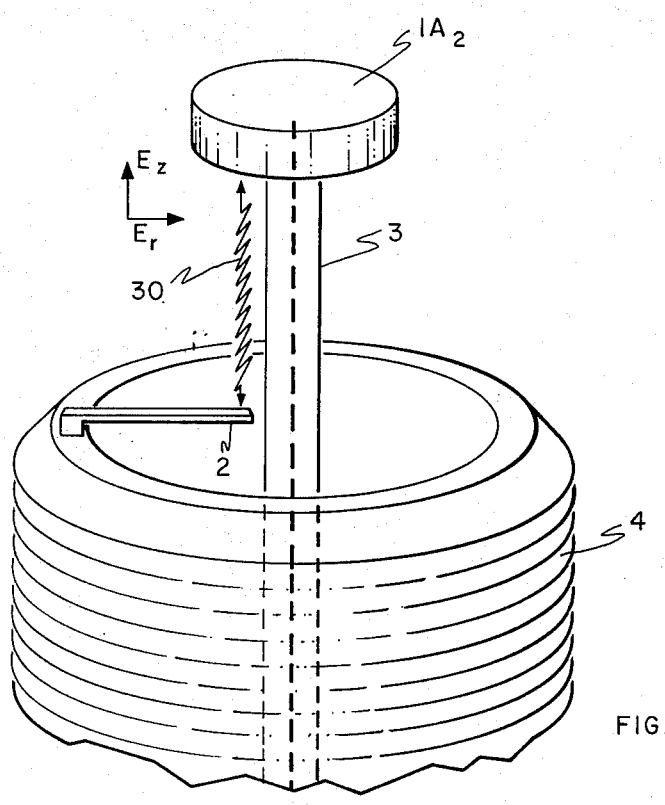
Figure 7:
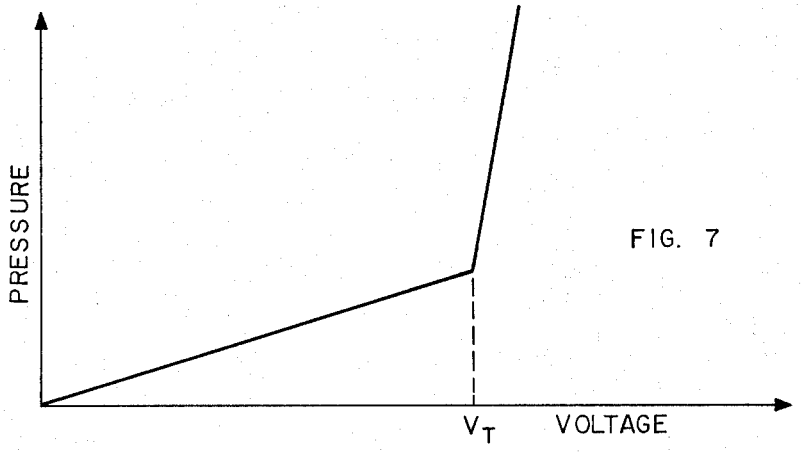
FIG. 7 is a pressure vs. voltage curve showing the magnitude of applied potential required to initiate an arc in a spark plug like that shown in FIG. 6 hereof.

FIG. 7 shows the voltage that was discovered for present purpose to be required to achieve an arc discharge between electrodes, like those in FIG. 1, as a function of pressure. The electrode spacing depicted in FIG. 6 is 0.340 inches. (The concepts herein disclosed have greatest merit in connecton with large-gap plugs, e.g., ~5mm and above.) It should be noted that there is a marked decrease in pressure dependence once a threshold voltage $V_T$ has been reached.

Figure 4:
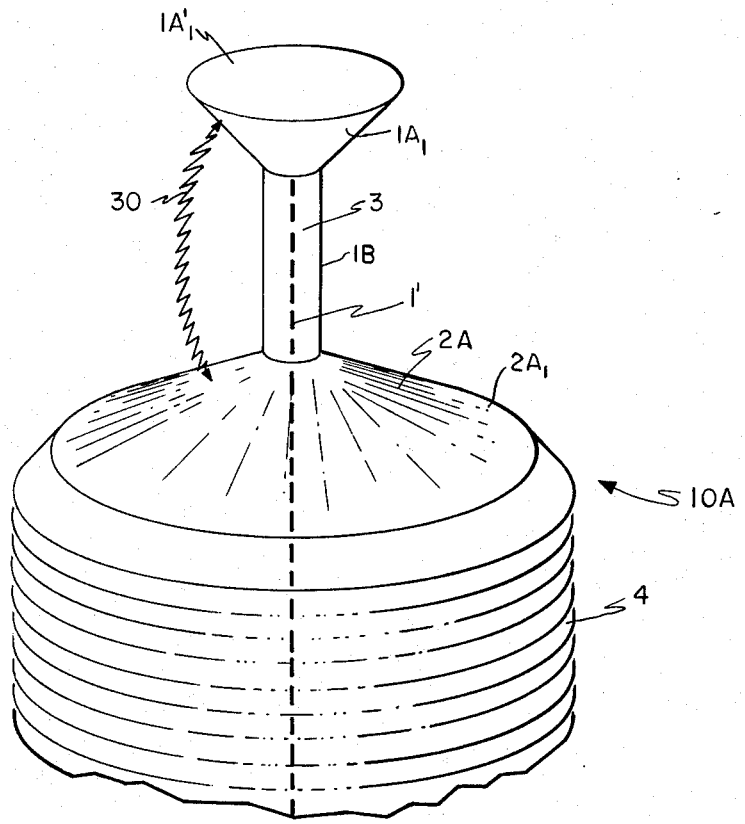
FIGS. 4, 5 and 6 are partial elevation views showing modifications of the spark plug of FIG. 1.

A structure adapted to use the control features herein described is shown at 10A in FIG. 4. (In FIG. 4, elements that can be identical to those in FIG. 1 have the same designation and those that perform the same function but are not identical have similar designations.) The arc, again marked 30, is formed between the tapered sparking surface portion $1A_1$ of the high voltage electrode marked 1' and a grounded electrode 2A having a tapered sparking surface $2A_1$. As the radial force due to the repulsion between the current in the arc and the current in the high voltage electrode 1' forces the arc away from the electrode 1', the length of the arc increases. By controlling the current, carried by the arc, as later discussed herein, the radial force can be varied and hence the length of the arc. At sufficiently high current and for the proper shape of the sparking surface of the electrodes, the arc can be "blown out" by the radial force. A new arc will form and be extinguished in the same manner. Thus, a continual striking and extinguishing of the arc will occur. This phenomenon has been observed using a structure like that shown in FIG. 4. The spark or arc moving radially outward created an entire sheet of discharge. In an operating system, the outward motion of the discharge will act to push the initial flame kernel away from the plug where it would tend to be quenched. Furthermore, there is a marked distribution of energy and temperatures in this new type discharge. Near the jacketed insulator the arc is blue in color becoming orange at a larger radius. This may be beneficial in matching the energy and temperature of the discharge to the chemical reaction to be initiated in the combustion process.

A few further aspects of the spark plug 10A in FIG. 4 are contained in this paragraph. As above noted, the plug 10A has tapered sparking surfaces $1A_1$ and $2A_1$ between which there is a gap that gradually increases in length from the solid insulation (again marked 3) radially outward from the stem portion (again marked 1B) of the high voltage or first electrode 1'. The upper conductive member having the sparking surface $1A_1$ is a conductive cap $1A_1'$ in the shape of a frustum of a cone at and forming the exposed portion of the first electrode 1'; the ground electrode or second electrode 2A is a conducting annulus surrounding fhe first electrode 1' near the base. An arc formed in an operating spark plug can be controlled in length between the two tapered sparking surfaces $1A_1$ and $2A_1$.

Figure 5:
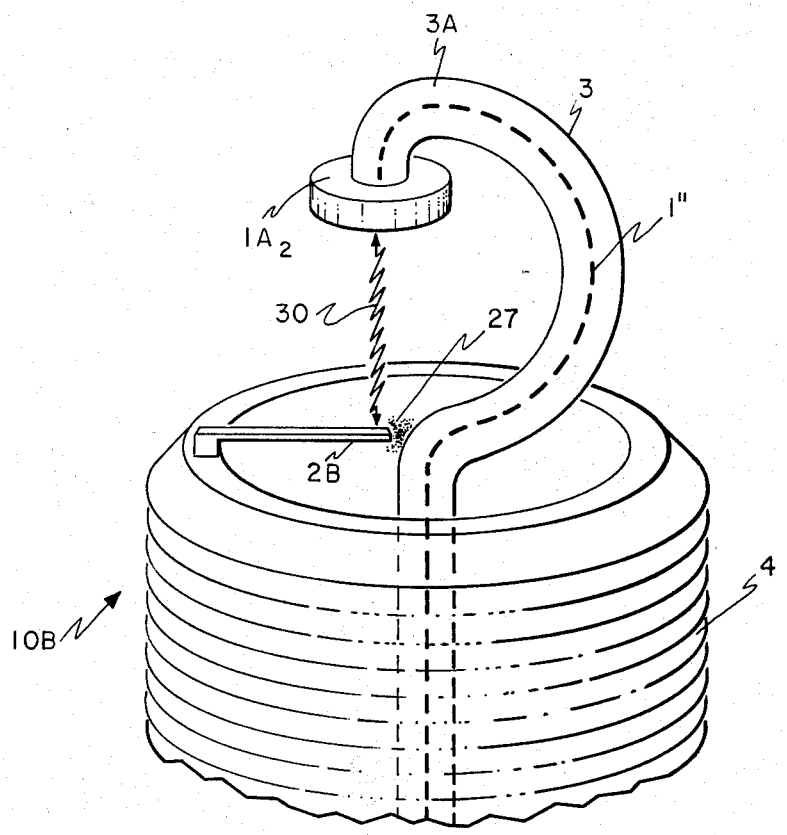

A further configuration favoring the formation of a long arc is shown in FIG. 5 wherein the spark plug shown at 10B comprises the insulated high voltage electrode labeled 1'' which is curved or arcuate. An initial corona 27 forms between the ground electrode shown at 2B and the high voltage electrode 1'' through an insulating jacket 3A which may be made of a high temperature ceramic, as before. The corona 27 is drawn along the curve to the exposed sparking cap shown at $1A_2$ of the electrode 1''. At sufficiently high voltage, an arc, again marked 30, will form and will be established, as shown, between the cap electrode $1A_2$ and the ground electrode 2B. The curved shape assists in drawing the initial corona to the exposed cap $1A_2$. The plug 10B makes use of the advantages of the corona for charging and moving fuel droplets should they be present, for the generation of active species that promote the combustion process, and for the establishment of a long arc at high pressure. Control of the path of the arc will to some extent be possible due to the electric and magnetic forces acting on the arc. These magnetic forces can be augmented by the use of magnetic materials in the structure of the plug as discussed elsewhere herein. For example, the insulating jacket 3A could be made of a ferrite or contain ferrite or other high magnetic permeability particles. The magnetic material will amplify the magnetic field due to the current through the high voltage electrode 1''.

The use of low work function material in the electrodes (for example 1A and 2 of FIG. 1) and in the insulating jacket 3 of FIG. 1 can also be of use in facilitating the establishment of the corona discharge and the arc itself. Materials such as $LaB_6$, for example, have very low work functions and produce a copious supply of electrons as a result of elevated temperatures and electric fields. These electrons emanate from a combination of thermionic and field emissions. Electrons liberated in the high field produce and assist in the production of the corona and arc discharges. These discharges are initiated and maintained at higher pressures and lower voltages if the supply of electrons in the gas is enhanced. This is in part due to the ability of electrons accelerated by the electric fields present from the high voltage source to produce ionization in the gas. Of course, the insulating quality of the jacket 3 must be maintained so that breakdown through it does not occur.

The high voltage source that creates the initial corona discharge and establishes the arc can be adapted to perform several functions. It can supply a corona voltage and limit the corona current so as to suppress the formation of an arc until the desired instant. A fast rise time pulse can be impressed upon the corona voltage, which might be in the 5kv range, to create the arc. Multiple fast rise time arc-forming pulses could be supplied to form a sequence of arc discharges. Further, this sequence of arcs can be used in the ignition of a single fuel-air charge. The corona can be created simply as a consequence of the voltage increase associated with the voltage pulse that establishes the arc discharge. The corona stage of the discharge may last only for a very short time, e.g., $10^{-5}$ seconds. Some technical matters relating to the arc and an electric system to effect the various electrical functions herein disclosed are now taken up.

Figure 8:
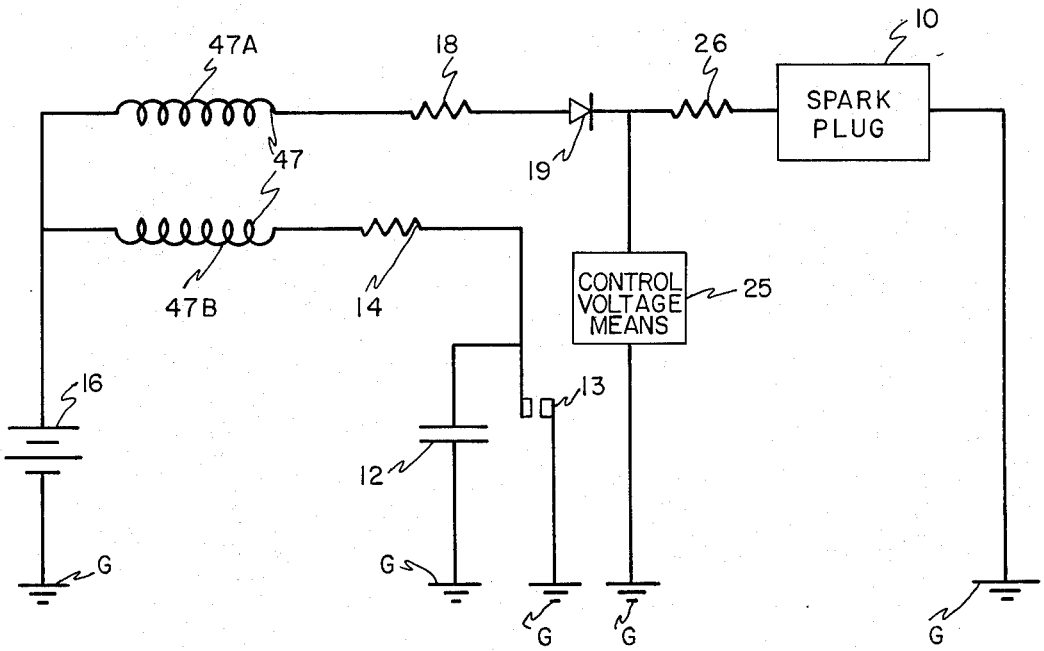
FIG. 8 is a schematic electric circuit diagram of a system that includes a spark plug like that shown in FIG. 1 plus a power supply to energize the spark plug and a control voltage to manipulate the arc.

The interaction between the current carried in the arc and the current flowing in the insulated high voltage electrode can be used to control the length of the arc, as is previously noted herein. One means of effecting this control is to vary the current carried by the arc. This can be done by using a variable current or voltage source connected across the plug terminals. When the arc discharge is off, the resistance $R_{off}$ of the plug is high, e.g., $10^6$ ohms. During a corona discharge preceding the arc, the resistance $R_{corona}$ is also quite high and the corona current in the $10^{-5}$ ampere range. When the arc is on, the resistance across the plug $R_{on}$ is drastically decreased from $R_{off}$. $R_{on}$ will usually be of the order of 10 ohms. A variable voltage or current source can now be used to pass a control current through the arc and consequently affect the force which tends physically to separate the arc from the currents flowing in the plug structure; and by using tapered sparking surfaces, for example, as shown in FIG. 4, the length of the arc is further affected. An electric circuit 15 using a control scheme is shown in FIG. 8 for a standard ignition system.

The electric circuit 15 includes a battery 16 and a coil 47. The coil 47 has two windings, 47A and 47B, as in a conventional system, one of which, 47A is connected through a resistance 18 and diode 19 to the single spark plug 10 in FIG. 8. The winding 47B is connected through a resistance 14 to points 13 and parallel condenser 12. Control voltage means performs the function of varying the electric current carried by the arc so as to control its physical nature; it is represented in FIG. 8 by a Thevenin equivalent voltage source 25 and a Thevenin resistance 26.

Figure 9:
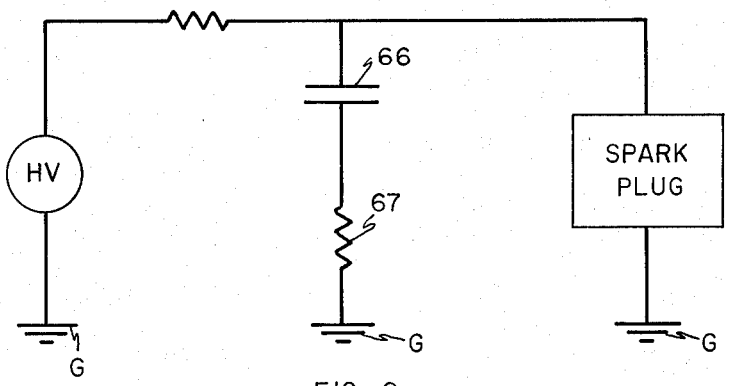
FIG. 9 is a schematic circuit diagram showing a further circuit arrangement to energize the spark plug herein disclosed.

FIG. 9 shows a circuit which allows variations of the effective self-capacitance of the plug by putting a capacitor 66 across the spark gap. A resistor 67 is put in series with the capacitor to control the RC time constant of the discharge of the capacitor which occurs when the gap 6 (in FIG. 1) breaks down and switches from a high impedance of the order of $10^6$ ohms to a low impedance of the order of 1 ohm as a result of the arc discharge. The energy stored in the capacitor 66 is discharged into the arc and the arc current is increased. This results in an increase in the electromagnetic force that pushes the arc away from the jacketed electrode. Varying capacitances control the arc current and varying resistors control the duration of the current. A capacitor of approximately 100 pf was observed to increase the energy of the arc. A computer could use feedback signals from the engine operation to control the value of the resistor 67 and/or the capacitor 66. During cold start conditions and in circumstances where fouling is aggravated, additional arc current would be helpful in insuring ignition.

In a combustion engine system which includes a computer capable of rapid control of the engine operating parameters such as fuel-air ratio, spark timing, and the like, a further control of the nature of the arc discharge of each plug could be effected by manipulating the output of a variable voltage or current source connected to the plug. The individual firings of each plug could be controlled not only as to the timing of the discharge but its physical nature as well, e.g., amount of corona, length of the arc discharge and duration of the arc discharge.

Modifications of the invention herein disclosed will occur to persons skilled in the art and all such modifications are deemed to be within the spirit and scope of the invention as defined by the appended claims.

What is claimed is:

1. For use in an internal combustion engine, a spark plug that comprises, in combination, a high voltage electrode that extendes axially outward from the base of the spark plug, an insulating jacket covering said high voltage electrode extending continuously from the base of the plug to the region of the free end of the high voltage electrode, the free end of the high voltage electrode being exposed, the high voltage electrode at said free end being formed to have a sparking surface oriented at an angle to the axially extending part of the high voltage axial electrode, a ground electrode extending from the body of the spark plug to the vicinity of the insulating jacket on the high voltage electrode and having a sparking surface oriented at an angle to said axis, there being a separation between the ground electrode and the high voltage electrode through the insulating jacket that is much less than the gap between the sparking surface of the ground electrode and the sparking surface of the high voltage electrode, the sparking surface of the electrodes being properly tapered such that an arc formed in an operating spark plug follows a curved path meeting each tapered sparking surface along a direction such that the discharge bends away from said axially extending part, said arc varying in character in an outward radial direction from said axially extending part to provide a distribution of energy and temperature in the arc.

2. A spark plug as claimed in claim 1 in which the high voltage electrode at said free end is shaped to provide a tapered sparking surface, the sparking surface of the ground electrode also being tapered.

3. A spark plug as claimed in claim 1 in which said gap is at least the order of 5 mm in length and in which said separation is the order of 1 mm.

4. A spark plug as claimed in claim 1 in which the insulating jacket is quite thin to provide high electric field intensity in the environment about the axial electrode to enhance corona conditions that are found in an operating system in the region about the ground electrode.

5. A spark plug as claimed in claim 4 in which the geometries of the high voltage electrode and the ground electrode and the positioning of the two electrodes relative to one another are such that in an operating system the electric current in the high voltage electrode interacts with the electric current in the arc in a way that a force is exerted on the arc in a direction away from the high voltage electrode, thereby to influence the physical location of the arc.

6. A spark plug as claimed in claim 5 in which the insulator contains magnetic particulate of sufficient size and in sufficient quantity to enhance the interaction between the electric currents in the arc and the current flowing in the high voltage electrode.

7. A spark plug as claimed in claim 1 wherein the high voltage electrode and the ground electrode are shaped, positioned and oriented to provide a configuration wherein the arc that forms between the high voltage electrode and the ground electrode in an operating system is subjected to a force due in part to the electromagnetic interaction between the electric current in the arc and the electric current in the high voltage electrode, and in part due to the electrode shapes, positions, and orientation so that the arc will be forced away from the high voltage electrode.

8. In a combustion system, a spark plug and high voltage means interconnected, said spark plug comprising electrode means that acts in combination with the high voltage means to create first a corona discharge and then an arc discharge through the corona, the electrode means being shaped and positioned to create a substantially long arc along a path whose shape and location are determined in part by the corona discharge and, hence, by the shape and position of the electrode means, the electrode means of the spark plug being further shaped and positioned to provide a configuration wherein the electromagnetic interaction between electric current in the arc and electric current in the electrodes acts to provide a force on the arc which plays a substantial role in determining the path of the arc, the electrode means having tapered sparking surfaces with a gap between the surfaces that varies at different positions on said surfaces.

9. A system as claimed in claim 8 in which the electrode means comprises high voltage electrode means and ground electrode means, said configuration being such that spatial motion of the arc is caused by virtue of the current in the high voltage electrode means electromagnetically interacting with the electric current in the arc.

10. A system as claimed in claim 9 in which the high voltage electrode means is covered by an insulating jacket except for an exposed portion thereof, the ground electrode means being disposed adjacent the high voltage electrode means but being separated therefrom by the insulating jacket so that corona discharge can be created between the high voltage electrode means and the ground electrode means, arcing occurring between the exposed portion of the high voltage electrode means and the ground electrode means through the corona discharge and initiated only in the event of the existence of the corona discharge.

11. A system as claimed in claim 10 in which the gap between the high voltage electrode means and the ground electrode means is at least the order of 5mm in length, in which the insulating jacket is a substantially thin jacket and in which magnetic particulate is distributed within the insulating jacket to enhance said electromagnetic interaction.

12. A spark plug that comprises, in combination, electrode means to create a corona discharge and an arc discharge, the electrode means having tapered sparking surfaces, the electrode means being shaped and positioned to create a substantially long arc along a path whose shape and location are determined in part by the corona discharge and, hence, by the shape and position of the electrode means, the electrode means being further shaped and positioned to provide a configuration wherein the path of the arc is determined, in part, by the electromagnetic interaction between electric current in the arc and electric current in the electrodes and, in part, by the shape, position and orientation of the electrodes so that the arc will tend to move by virtue of said electromagnetic interaction to provide a continuously changing position of the arc to increase ignition volume and to match the energy and temperature of the arc to the chemical action to be initiated in the combustion process by the spark plug.

13. A spark plug as claimed in claim 12 in which the electrode means comprises a high voltage electrode and a ground electrode, said configuration being such that the arc is caused to move away from the high voltage electrode.

14. A spark plug as claimed in claim 13 in which the high voltage electrode is covered by an insulating jacket except for a small portion thereof, the ground electrode being very close to the high voltage electrode at a region thereof that is covered by the insulating jacket so that corona discharge can be created between the high voltage electrode and the ground electrode without the onset of arc discharge, arcing occurring between the small exposed portion of the high voltage electrode and the ground electrode through the corona discharge.

15. A spark plug that comprises, in combination, electrode means to create a corona discharge and an arc discharge, the electrode means being shaped and positioned to create a substantially long arc along a path whose shape and location are determined in part by the corona discharge and, hence, by the shape and position of the electrode means, the electrode means being further shaped and positioned to provide a configuration wherein the electromagnetic interaction between electric current in the arc and electric current in the electrodes acts so that the arc will tend to move by virtue of said electromagnetic interaction, said electrode means comprising a high voltage electrode and a ground electrode, said configuration being such that the arc is caused to move away from the high voltage electrode, the high voltage electrode being covered by an insulating jacket except for a small portion thereof, the ground electrode being very close to the high voltage electrode at a region thereof that is covered by the insulating jacket so that corona discharge can be created between the high voltage electrode and the ground electrode without the onset of arc discharge, arcing occurring between the small exposed portion of the high voltage electrode and the ground electrode through the corona discharge, the insulating jacket containing magnetic particulate distributed within said jacket to enhance said electromagnetic interaction.

16. A spark plug as claimed in claim 15 in which the magnetic particulate is the order of 100–1000 Angstroms in size and is distributed within the insulating jacket.

17. A spark plug as claimed in claim 17 in which the gap between the high voltage electrode and the ground electrode is at least the order of 5mm and in which the insulating jacket is thin enough to create a high electric field region between the high voltage electrode and the ground electrode.

18. A spark plug that comprises, in combination, a first electrode isolated from the plug body that extends outward from the base of the spark plug at one end of the plug and extends as well to effect electrical connection to a terminal at the other end of the plug, the first electrode being surrounded by solid insulation from the terminal to an exposed portion at said one end, the part of the first electrode that extends outward from the base having an exposed portion to act as a sparking surface but is otherwise covered completely by solid insulation in the form of a thin insulating jacket, a second electrode connected to and extending from the body of the spark plug to a region of the first electrode that is surrounded by the solid insulation, there being a separation between the second electrode and the first electrode through the solid insulation that is much less than the gap that exists between the second electrode and said exposed portion of the first electrode, the sparking surface of at least one said electrode being tapered such that an arc formed can be controlled in length and in spatial behavior.

19. A spark plug as claimed in claim 18 in which one of the two electrodes is composed of a low work function material.

20. A spark plug as claimed in claim 19 in which the low work function material is $LaB_6$.

21. A spark plug as claimed in claim 18 which comprises a conductive cap at said exposed portion.

22. A spark plug as claimed in claim 21 in which the cap has a tapered sparking surface and in which the second electrode is a conducting annulus surrounding the first electrode near the base and also having a tapered sparking surface so that an arc formed in an operating spark plug can be controlled in length between two tapered sparking surfaces.

23. An electrical system that includes a spark plug as claimed in claim 18 in combination with electric voltage source means connected to energize the spark plug, to control the voltage and hence the electric current carried by the spark plug, thereby to control the physical nature of the arc that appears across said gap in an operating system.

24. An electrical ignition system that includes a spark plug as claimed in claim 18 in combination with electrical voltage source means connected to energize the spark plug, an RC network whose characteristics can be controlled so as to vary the arc current and energy connected between the plug and ground.

25. In a combustion system, a spark plug and high voltage means interconnected, said spark plug comprising electrode means that acts in combination with the high voltage means to create first a corona discharge and then an arc discharge through the corona, the electrode means being shaped and positioned to create a substantially long arc along a path whose shape and location are determined in part by the corona discharge and, hence, by the shape and position of the electrode means, the electrode means of the spark plug being further shaped and positioned to provide a configuration wherein the electromagnetic interaction between electric current in the arc and electric current in the electrodes acts so that the arc will tend to move by virtue of said electromagnetic interaction, said electrode means comprising an electrode that extends outward from the base of the plug and has an exposed portion to act as a sparking surface but is otherwise covered completely by solid insulation in the form of a thin insulating jacket, the outwardly extending electrode being arcuate from the base to said exposed portion and having a conductive cap at the exposed portion, which cap has a sparking surface.

26. A spark plug that comprises, in combination, a first electrode isolated from the plug body that extends outward from the base of the spark plug at one end of the plug and extends as well to effect electrical connection to a terminal at the other end of the plug, the first electrode being surrounded by solid insulation from the terminal to an exposed portion at said one end, a second electrode connected to and extending from the body of the spark plug to a region of the first electrode that is surrounded by the solid insulation, there being a separation between the second electrode and the first electrode through the solid insulation that is much less than the gap that exists between the second electrode and said exposed portion of the first electrode, said gap gradually increasing from the solid insulation radially outward from the solid insulation.

27. A spark plug that comprises, in combination, a first electrode isolated from the plug body, which first electrode extends outward from the base of the spark plug at one end of the plug and extends as well to effect electrical connection to a terminal at the other end of the plug, the first electrode being surrounded by solid insulation along a stem portion from the base to an exposed portion at said one end, a second electrode connected to and extending from the body of the spark plug to a region of the first electrode that is surrounded by the solid insulation, there being a separation between the second electrode and the first electrode through the solid insulation that is much less than the gap that exists between the second electrode and said exposed portion of the first electrode, exposed sparking surfaces of the first electrode and the second electrode being shaped, oriented and positioned to provide a gap that gradually increases from said stem portion radially outward from the solid insulation.

28. A spark plug that comprises, in combination, a first electrode isolated from the plug body, which first electrode extends outward from the base of the spark plug at one end of the plug and extends as well to effect electrical connection to a terminal at the other end of the plug, the first electrode being surrounded by solid insulation from the terminal to an exposed portion at said one end, a second electrode connected to and extending from the body of the spark plug to a region of the first electrode that is surrounded by the solid insulation, there being a separation between the second electrode and the first electrode through the solid insulation that is much less than the gap that exists between the second electrode and said exposed portion of the first electrode, one of the two electrodes being composed of a low work function material.

29. A spark plug as claimed in claim 28 in which the low work function material is $LaB_6$.

30. A spark plug that comprises, in combination, a first electrode isolated from the plug body, which first electrode extends outward from the base of the spark plug at one end of the plug and extends as well to effect electrical connection to a terminal at the other end of the plug, the first electrode being surrounded by solid insulation from the terminal to an exposed portion at said one end, a second electrode connected to and extending from the body of the spark plug to a region of the first electrode that is surrounded by the solid insulation, there being a separation between the second electrode and the first electrode through the solid insulation that is much less than the gap that exists between the second electrode and said exposed portion of the first electrode, the insulation containing magnetic particulate of sufficient size and in sufficient quantity to enhance the interaction between the electric currents in the arc formed across said gap in an operating system and the current flowing in the high voltage electrode.

31. In a combustion system, a spark plug and high voltage means interconnected, said spark plug comprising electrode means that acts in combination with the high voltage means to create first a corona discharge and then an arc discharge through the corona, the electrode means being shaped and positioned to create a substantially long arc along a path whose shape and location are determined in part by the corona discharge and, hence, by the shape and position of the electrode means, the electrode means of the spark plug being further shaped and positioned to provide a configuration wherein electromagnetic interaction between electric current in the arc and electric current in the electrodes acts so that the arc will tend to move by virtue of said electromagnetic interaction, said high voltage means being operable to introduce to the spark plug a voltage waveform that serves to provide timing for both the corona discharge and the arc discharge.

* * * * *